United States Patent [19]

Sharon

[11] 4,455,787

[45] Jun. 26, 1984

[54] ENGINE FAN CASE GRINDER

[75] Inventor: Harold M. Sharon, Glastonbury, Conn.

[73] Assignee: United Technologies Corporation, Hartford, Conn.

[21] Appl. No.: 317,634

[22] Filed: Nov. 2, 1981

[51] Int. Cl.[3] ..... B24B 19/08; B24B 19/26

[52] U.S. Cl. ..... 51/241 S; 51/241 B; 51/245

[58] Field of Search ..... 51/241 R, 241 S, 241 B, 51/245, 251

[56] References Cited

U.S. PATENT DOCUMENTS

| | | | |
|---|---|---|---|
| 1,425,592 | 8/1922 | Jennings | 51/245 |
| 1,633,885 | 6/1927 | Castillo | 51/241 B |
| 1,714,103 | 5/1929 | Parks | 51/241 B |
| 1,933,677 | 11/1933 | Moore | 51/245 |
| 2,458,472 | 1/1949 | Irwin | 51/245 |
| 3,069,819 | 12/1962 | Gilmore | 51/245 |

*Primary Examiner*—Roscoe V. Parker

*Attorney, Agent, or Firm*—Charles A. Warren

[57] ABSTRACT

A device for grinding a fan case for a gas turbine engine to provide an eccentric opening. The device employs a rotatable hub mounted on the fan shaft by a pair of eccentric sleeves one surrounding the other for adjusting the eccentricity of the hub relative to the shaft.

12 Claims, 8 Drawing Figures

ENGINE FAN CASE GRINDER

DESCRIPTION

1. Technical Field

A device for grinding a fan case for a gas turbine engine to provide an eccentric opening in which the fan is located. The case structure is such that the fan tip may engage the casing during certain periods of operation such as takeoff when the fan case is distorted by pressures thereon.

2. Background Art

It has been found that certain gas turbines used in aircraft have a fan case that is distorted during certain operating conditions such as takeoff so that the casing in certain instances may engage the fan tips causing damage to the fan or to the surround surface in the case. This problem may be eliminated by making the fan opening in the casing eccentric so that as the casing is distorted there is still enough clearance between the fan tips and the casing to avoid contact. In engines that are already in service in aircraft it is desirable to produce this eccentricity without the need for the removal of the engine from the aircraft.

DISCLOSURE OF INVENTION

A feature of this invention is a grinder that may be installed in the engine shaft and by which the desired concentric surface may be ground in the fan case.

Another feature is the ability to grind this eccentric surface while the engine is still mounted in the aircraft and to produce the desired eccentricity in the desired location with relation to the aircraft.

Another feature is a grinder adapted to be mounted on the engine shaft and so arranged that you can grind the top half of the fan case to be eccentric to the shaft and the bottom half to be eccentric to the shaft but concentric to a point located closely below the engine shaft.

According to the invention a grinder has a hub to be mounted on the engine shaft with two eccentric cams so positioned and each having the same amount of eccentricity so that the grinder rotating on the axis of the shaft may grind either a concentric surface or a surface that is eccentric to the shaft by selective adjustment of the cams. An arm pivoted on the outer eccentric cam carries a grinding element at its outer end in a position to engage the fan case and perform a grinding operation thereon.

For the cams position to cancel each other the grinding element will produce a ground surface concentric to the engine shaft and then with the cams out of this position to provide the desired amount of eccentricity. The location of the offset may be established by the position of the cams and this will cause the grinding element to produce a ground surface in a part of a fan case that is eccentric to the shaft axis and in the right location in the casing.

The foregoing and other objects, features and advantages of the present invention will become more apparent in the light of the following detailed description of the preferred embodiments thereof as shown in the accompanying drawing.

BEST MODE FOR CARRYING OUT THE INVENTION

The purpose of the device is to permit the grinding of a part of the fan case to a surface that is concentric to the engine shaft and to grind the remainder of the fan case to a surface that is eccentric to the engine shaft. One need for this has resulted from the deflection of the fan case during takeoff where it is found that the lower half of the fan case is deflected upwardly enough to cause the case to engage with the tips of the fan blades. This is presumably a result of the air pressures acting on the fan case as the aircraft begins its lift-off from the ground at a time when the axes of the engines make a steep angle with respect to the surrounding air so that the wind pressures on the lower half of the fan case may distort it.

To accomplish this the grinding drum is mounted at the outer end of a bar that is pivoted on the engine axis, this drum being in a position to engage the surface in the casing that surrounds the fan at the tips of the blades. The hub for the supporting bar is positioned on a pair of interfitting eccentric sleeves that may be turned relative to one another to shift the axis of rotation of the hub to a point spaced from the engine axis. With the eccentric sleeves positioned to cancel the eccentricity of each other the hub will rotate on the engine axis to produce the desired concentric surface for the casing surrounding the fan. Then, by shifting the position of the eccentrics to the desired extent the remaining portion of the casing may be ground eccentric to the engine axis.

Figure 2:
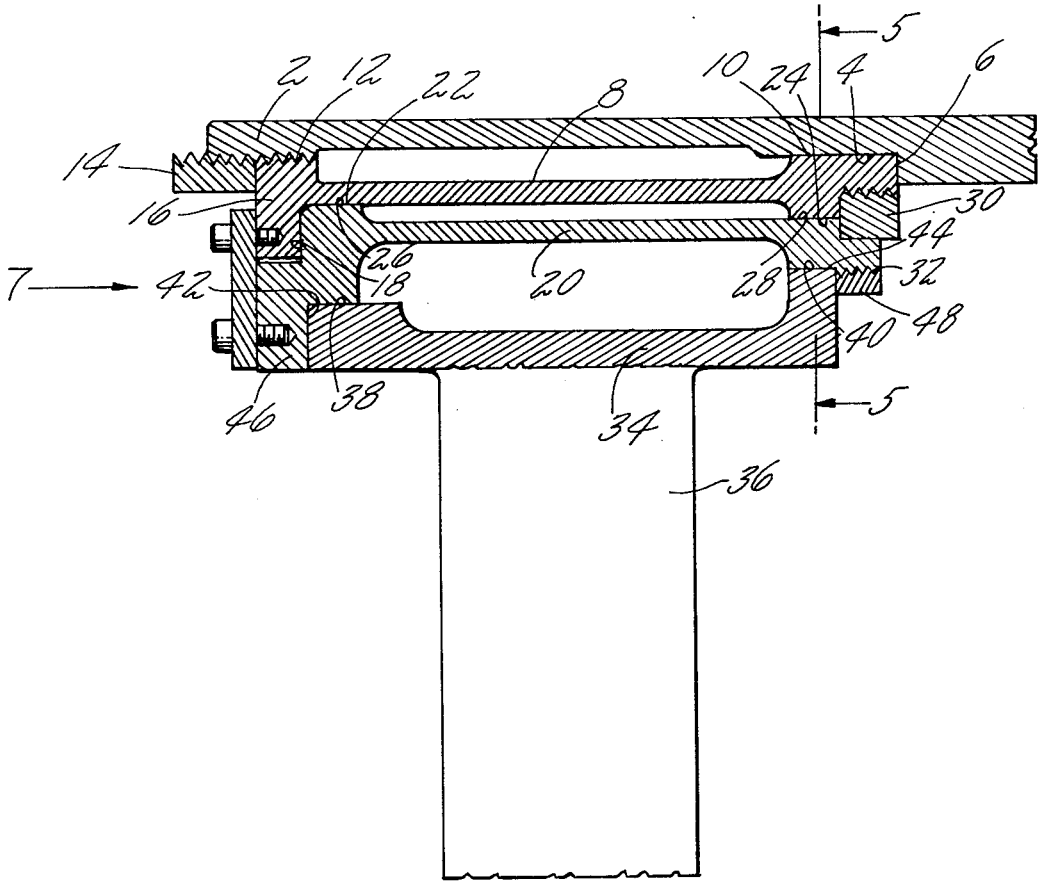
FIG. 2 is a sectional view along the line 2—2 of FIG. 1.
Figure 7:
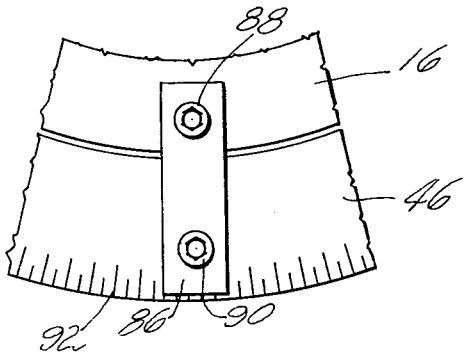
FIG. 7 is a plan view of a detail.
Figure 4:
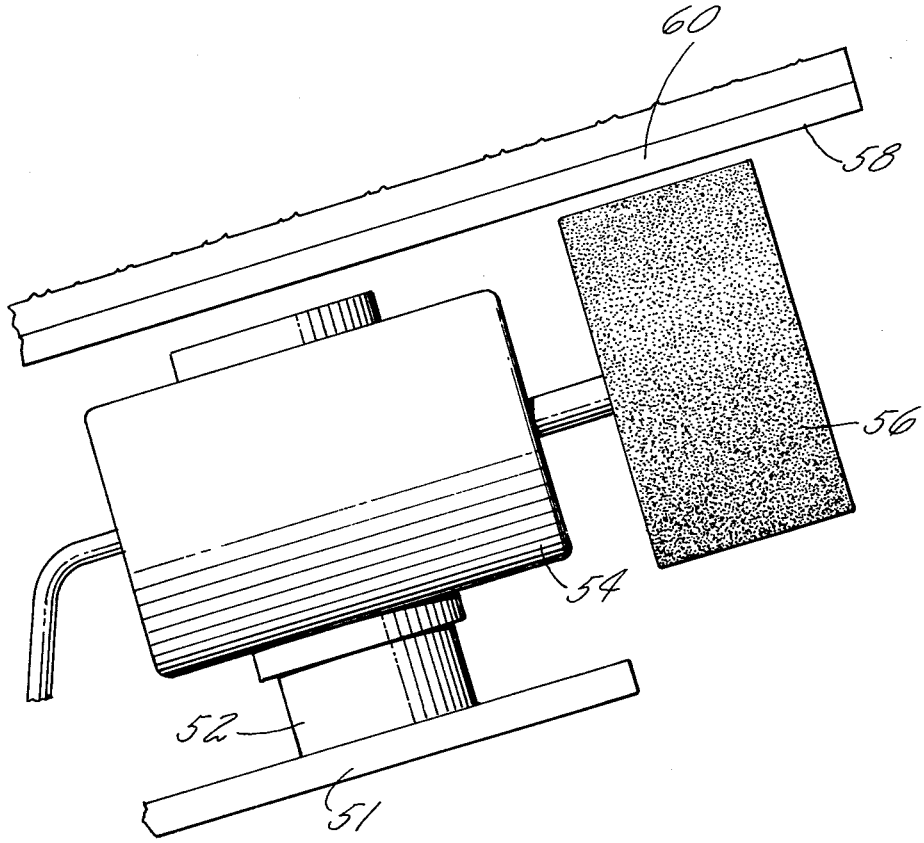
FIG. 4 is an enlarged view at right angle to FIG. 3.

Referring first to FIG. 2, the engine shaft has a threaded end 2, a pilot surface 4 spaced therefrom and a shoulder 6 at the end of the surface 4. A first eccentric sleeve 8 has an inner surface 10 engaging the pilot surface 4 and a spaced threaded inner surface 12 engaging the threads 2. A nut 14 secures the sleeve 12 against removal.

The inner or first eccentric sleeve 8 has an outer flange 16 engaged by a shoulder 18 on a second eccentric sleeve 20 surrounding the first sleeve. This sleeve 20 has spaced pilot surfaces 22 and 24 engaging cooperating pilot surfaces 26 and 28 on the sleeve 8 and the sleeve 20 is held in position axially by a nut 30 engaging threads 32 on the sleeve 8. The outer or second sleeve 20 is free to turn on the inner sleeve for purposes of adjustment.

A hub 34 for the grinder bar 36 is positioned on the outer sleeve. This hub has inner pilot surfaces 38 and 40 engaging cooperating piloting surfaces 42 and 44 on the outer sleeve. A flange 46 at one end of the outer sleeve and a clamping nut 48 on the other end prevent axial movement of the hub and allow it to rotate on the sleeve for a purpose of the grinding operation.

Figure 1:
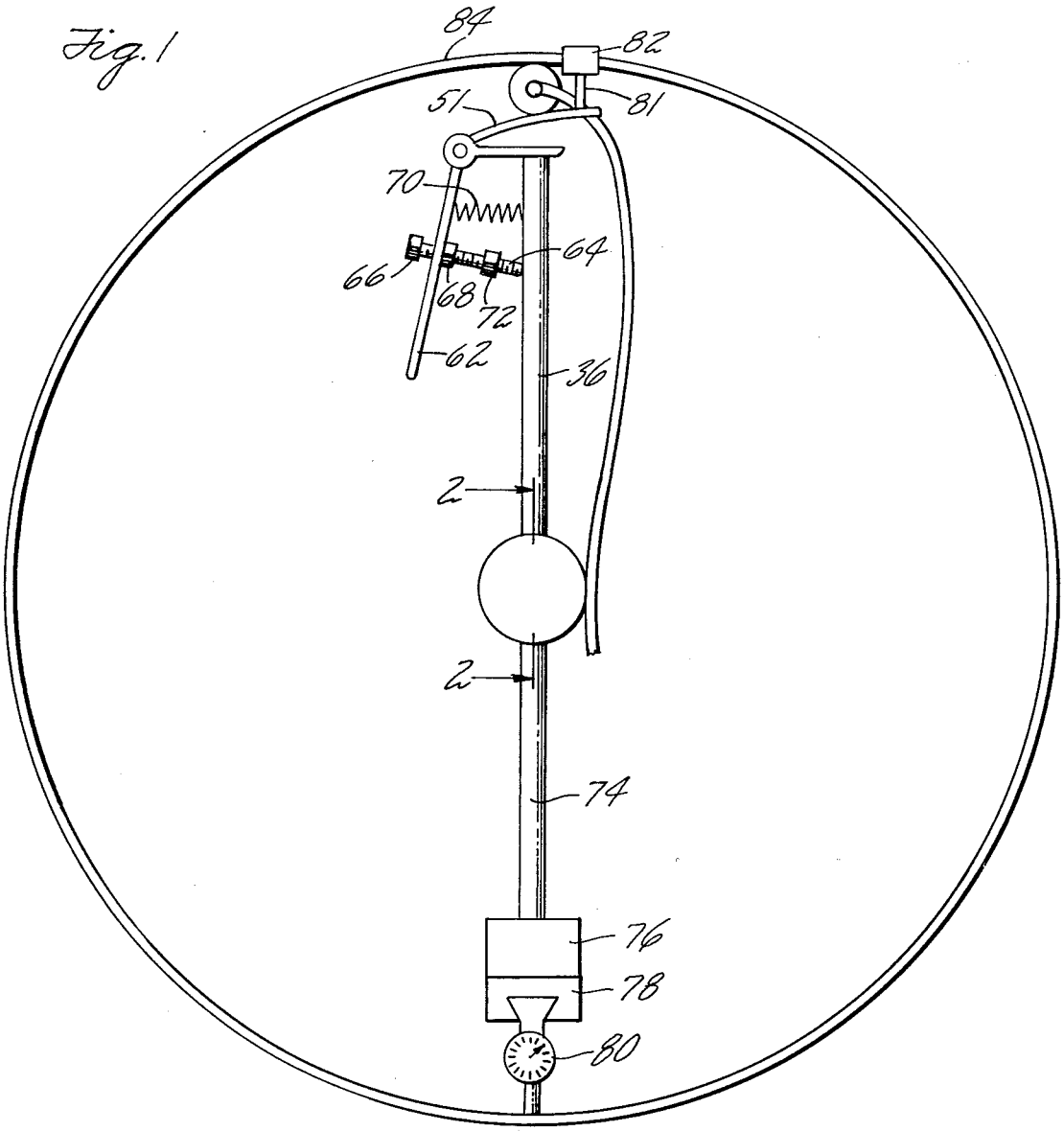
FIG. 1 is a partial elevation of a grinder embodying the invention.
Figure 3:
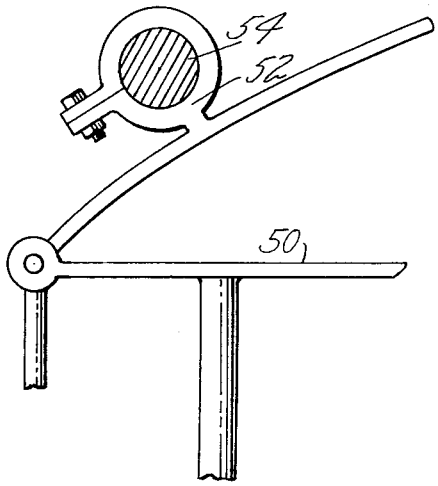
FIG. 3 is an enlarged elevational view of the supporting structure for the drum sander.

The bar 36 extends outwardly from the hub and carries at its outer end a plate 50 to the edge of which is hinged a bracket 51 carrying a clamping device 52, FIG. 3, to receive the casing and the motor 54 for the sander drum 56. The latter is in a position to engage the sealing surface 58 in the cowling ring 60 surrounding the fan in the engine. This ring is generally somewhat conical and the hinge axis for the clamping ring is parallel to the sealng surface to assure the positioning of the cutting surface of the drum parallel to the sealing surface to be ground.

The drum sander is generally urged manually against the surface to be ground by an arm 62 secured to the bracket 51 and extending toward the axis of the device. Movement of the arm 62 is limited by a stud 64 extending from the bar 36 and through the arm 62. Movement of the arm is limited in a direction to disengage the sander drum by a nut 66 adjustable on the stud and in a direction to engage the drum by a nut 68. A spring 70 may serve to hold the sander drum normally out of contact with the surface to be ground with the sander being urged against the tension of this spring in holding it manually against the surface. The second nut 68 by manual turning thereof permits a control of the depth of cut made by the sander during the sanding operation. A further nut 72 limits the movement of nut 68 and determines the position of the drum when the surface being ground has reached the desired dimensions.

To balance the drum sander the hub 34 has a second projecting bar 74 in opposition to the bar 36. This bar 74 has a counterbalancing weight 76 to balance the weight of the drum sander. The bar 74 may also have at its end a dovetail groove to receive a dovetail fixture 78 carrying a dial indicator 80 for checking the dimension of the surface being ground. A further refinement may be an arm 81 extending out from the bracket 51 and having at its outer end a roller 82 to engage the edge 84 of the casing thus locating the sander drum axially of the casing ring in a position to grind the proper location on the sealing ring.

Figure 8:
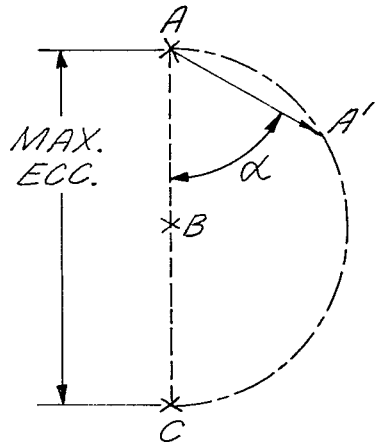
FIG. 8 is a diagrammatic view of the eccentricity compensation.

The device having been set up with the cams canceling one another, the sander drum is rotated about the hub to grind the portion of the fan case surface so as to be concentric to the shaft axis. When this grinding is completed the cams are positioned by rotating the second cam on the first cam to provide the desired eccentricity and the cams are then locked in position with respect to one another. The cams may be held against rotation once adjusted by a small plate 86 overlying the ends of the two cam rings and carrying a threaded pin 88 to engage the inner cam ring and another threaded pin 90 to engage the outer cam ring. By disengaging the outer pin 90 the second cam ring may be turned with respect to the first until the desired eccentricity is attained. Desirably the second cam ring will have indicating marks 92 thereon to indicate the amount of eccentricity in thousandths of an inch that is obtained by the amount that the cams are displaced. It will be understood that any amount of eccentricity may be obtained up to the limit of the maximum eccentricity of the two cam rings. To set the desired eccentricity the outer cam ring 20 is turned by means of the flange 46 thereon until the desired eccentricity is obtained, this being represented by the line A–A′ in FIG. 8. Referring to this figure the point A represents the engine centerline, the point B represents the center of the eccentric outer surface of cam 8 and the point C the center of the outer case 20 when at maximum eccentricity. As the outer cam is turned on the inner cam from the concentric position the centerline of the outer cam surface moves from the position A concentric to the shaft to the point C along the dotted line shown. Thus, to obtain the desired eccentricity the outer cam is turned to carry the centerline of that cam along this dotted line from A toward C. When the desired point A′ is reached to produce an eccentricity equal to the vector A–A′, the two cams are locked against rotation by the locking tab 8. The direction of A–A′ is shown on the sketch and in order to direct this vector in the desired direction, for example toward the bottom of the engine, so that the eccentricity will be in this direction, the entire apparatus is turned as a unit with the shaft on which it is mounted through the angle $\alpha$ thereby directing the vector A–A′ toward the bottom of the engine case. By the use of the indicia 92 on the cam face this adjustment is readily determined.

This device may be so constructed as to provide an additional compensation. It is known that when the engine is at rest the clearances in the bearings allow the shaft to move downwardly a significant distance from the actual centerline of the engine, that is to say the centerline about which the shaft rotates. This displacement of the engine shaft may be on the order of several thousandths of an inch. To correct the disk displacement during the grinding operation, the outer cam may have an eccentricity greater than the inner cam by an amount equal to the shaft displacement. Thus, when the grinder is in use and the eccentrics are in offsetting relation to one another the inner eccentricity toward the bottom and the outer eccentricity toward the top of the engine, the greater eccentricity of the outer eccentric will cause the grinder to rotate on the engine centerline thereby compensating for the displacement of the shaft while the grinder is in use. That is to say the grinder is in use when the engine is not in operation and thus at a time that the engine shaft is displaced downwardly from the engine centerline.

Figure 5:
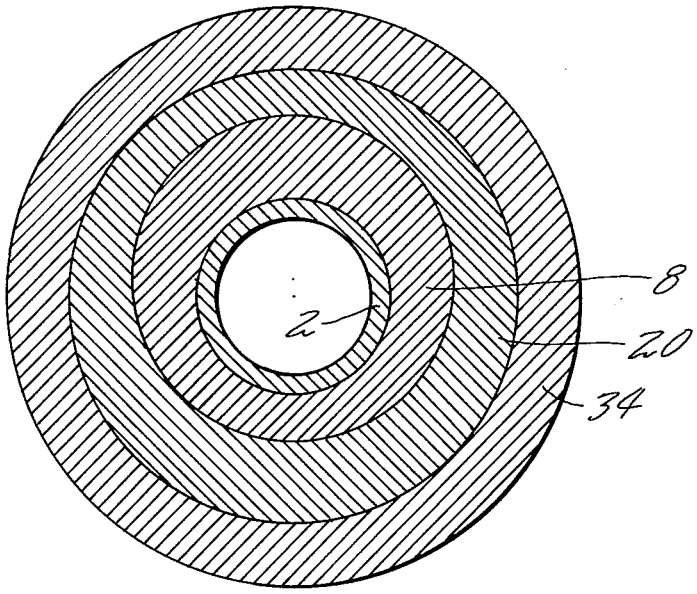
FIG. 5 is a schematic showing the cams in a concentric position for grinding the eccentric surface.
Figure 6:
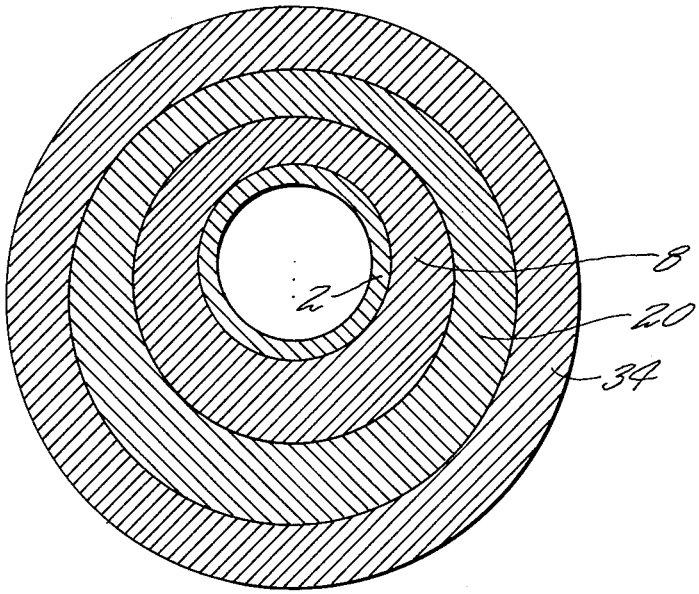
FIG. 6 is a schematic showing the cams in the offset position for grinding the eccentric surface.

Although it may appear that the grinding of these two surfaces on axes spaced from one another might leave an undesirable cusp between the two ground surfaces the height of this cusp will be insignificant with respect to the amount of eccentricity and the radius of the surface being ground. The function of the eccentric sleeves in positioning the hub so that a second surface may be ground that will be eccentric to the engine shaft is depicted in FIGS. 5 and 6 which show in the schematic way the position of the cams when they counterbalance one another and in the other view the position of the cams for producing an eccentricity totaling the maximum eccentricity of both of the sleeves. By positioning at other angles to each other it will be understood that any desired amount of eccentricity may be obtained up to the maximum of the two eccentrics. The important thing, however, is to have the center of eccentricity and the dimension of eccentricity obtained to be located with respect to the engine casing in such a position that the ground surface that is eccentric to the engine shaft will be in the right position. This has been explained above with respect to the provision of the plate 86 and its location with respect to the two cams.

Although the invention has been shown and described with respect to a preferred embodiment thereof, it should be understood by those skilled in the art that other various changes and omissions in the form and detail thereof may be made therein without departing from the spirit and the scope of the invention.

I claim:

1. A grinder for the fan shroud of a gas turbine engine said engine including a shaft, the grinder mechanism including:

a support structure attached to the engine shaft and including a pair of eccentric sleeves one surrounding the other;

a hub mounted on said structure;

a bar on said hub; and a grinder on the outer end of the bar, said eccentric sleeves being turnable one with respect to the other for adjusting the eccentricity of the hub relative to the shaft.

2. A grinder as in claim 1 in which the eccentricity of the sleeves is the same so that in one position of the sleeves the eccentricities cancel out and rotation of the hub may be on the axis of the support shaft.

3. A grinder as in claim 1 including a hinged plate at the outer end of the bar with the grinder on said plate and an arm in said plate for moving the grinder radially against the surrounding shroud.

4. A grinder as in claim 1 including means for clamping the eccentric sleeves against rotation in any selected position of the sleeves.

5. A grinder as in claim 4 in which one sleeve is movable and the other fixed and the clamping means are positioned to mark the maximum eccentricity for the movable sleeve.

6. A grinder as in claim 1 in which the hub carries a second bar thereon in opposition to said first bar, said second bar carrying a weight to counterbalance the grinder.

7. A grinder for producing an eccentric surface on the fan shroud of a gas turbine engine, said engine having a shaft, the grinder mechanism including:

a support structure for attachment to the end of the shaft and having means for holding the structure against rotation on the shaft, such structure including;

a pair of eccentric sleeves one surrounding the other, the outer sleeve being turnable with respect to the inner sleeve;

a hub journaled on said outer sleeve;

a bar on said hub extending radially therefrom;

a hinged plate on the outer end of said bar; and a grinder on said plate and in a position to engage the shroud.

8. A grinder as in claim 7 in which the axis of the hinged plate is parallel to the shroud to be ground.

9. A grinder as in claim 7 in which the plate has an arm by which the plate may be moved to urge the grinder against the shroud.

10. A grinder as in claim 9 in which the arm has adjustable limit stops to limit the arm movement whereby to limit the grinder movement.

11. A grinder as in claim 7 in which the hub has a second bar in opposition to the first bar and said second bar carries a balance weight for the grinder.

12. A grinder as in claim 7 in which the outer sleeve carries thereon means for clamping the sleeves in fixed relation one to the other and said clamping means are positioned to mark the maximum eccentricity of the movable sleeve.

* * * * *